US008782993B2

(12) United States Patent
Lawley

(10) Patent No.: US 8,782,993 B2
(45) Date of Patent: Jul. 22, 2014

(54) STRUCTURAL UNIT COMPRISING A TRUSS AND FIBROUS CEMENTITIOUS SLAB BUILDING ELEMENT CONNECTED TOGETHER

(75) Inventor: Derek Trent Lawley, Auckland (NZ)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/515,772

(22) PCT Filed: Dec. 13, 2010

(86) PCT No.: PCT/US2010/060065

§ 371 (c)(1),
(2), (4) Date: Jun. 13, 2012

(87) PCT Pub. No.: WO2011/081876

PCT Pub. Date: Jul. 7, 2011

(65) Prior Publication Data

US 2012/0247055 A1 Oct. 4, 2012

(30) Foreign Application Priority Data

Dec. 14, 2009 (NZ) ..... 582003

(51) Int. Cl.

| | |
|---|---|
| ***E04H 12/00*** | (2006.01) |
| ***E04C 3/29*** | (2006.01) |
| ***E04C 3/293*** | (2006.01) |
| ***E04C 2/04*** | (2006.01) |
| ***E04C 5/06*** | (2006.01) |
| ***E04B 5/16*** | (2006.01) |
| ***E04B 1/04*** | (2006.01) |

(52) U.S. Cl.

CPC . *E04C 3/29* (2013.01); *E04C 3/293* (2013.01); *E04C 2/044* (2013.01); *E04C 5/0645* (2013.01); *E04B 5/16* (2013.01); *E04B 1/043* (2013.01)

USPC ..... 52/655.1

(58) Field of Classification Search

CPC ..... E04C 2/044; E04C 3/29; E04C 3/293; E04C 3/02; E04B 5/16; E04B 1/043

USPC ..... 52/633, 634, 636, 638, 648.1, 655.1, 52/696, 690, 693, 837, 838

See application file for complete search history.

(56) References Cited

U.S. PATENT DOCUMENTS 2,996,160 A * 8/1961 Voight ..... 52/376
3,330,084 A * 7/1967 Russell ..... 52/300

(Continued)

FOREIGN PATENT DOCUMENTS

DE 1018083 B 10/1957
DE 1659218 A1 1/1971

(Continued)

OTHER PUBLICATIONS

International Search Report for PCT/US2010/060065 dated Jun. 6, 2011.

(Continued)

*Primary Examiner* — Mark Wendell
*Assistant Examiner* — Keith Minter
(74) *Attorney, Agent, or Firm* — Lowe Hauptman & Ham LLP

(57) ABSTRACT

The present invention relates to improvements to building construction. Particularly, the present invention relates to a structural unit for the use in building construction of floors, roofs and walls of a building. There is provided a structural unit for a building comprising: at least one truss; at least one fibrous cementitious building element; and at least one connection member configured to connect the at least one truss to the at least one fibrous cementitious building element, wherein, the connection member is integral with the building element and accessible for connection of the at least one truss to the building element. Also claimed is a method of constructing the structural unit.

22 Claims, 16 Drawing Sheets

(56) References Cited

U.S. PATENT DOCUMENTS

| | | | | |
|---|---|---|---|---|
| 4,078,352 | A * | 3/1978 | Knowles | 52/693 |
| 4,182,092 | A * | 1/1980 | Weaver | 52/584.1 |
| 4,283,896 | A * | 8/1981 | Fricker et al. | 52/410 |
| 4,495,688 | A * | 1/1985 | Longpre et al. | 29/460 |
| 4,527,372 | A * | 7/1985 | Ryan | 52/334 |
| 4,530,191 | A * | 7/1985 | Boisbluche | 52/309.7 |
| 4,653,237 | A * | 3/1987 | Taft | 52/335 |
| 4,669,243 | A * | 6/1987 | Gore et al. | 52/696 |
| 4,862,662 | A | 9/1989 | Eberle et al. | |
| 5,234,279 | A * | 8/1993 | Poutanen | 403/403 |
| 5,592,800 | A * | 1/1997 | Koo et al. | 52/692 |
| 5,809,723 | A * | 9/1998 | Keith et al. | 52/405.1 |
| 5,833,421 | A * | 11/1998 | Lees et al. | 411/466 |
| 5,867,963 | A * | 2/1999 | Hershey | 52/650.2 |
| 6,088,985 | A * | 7/2000 | Clark | 52/309.11 |
| 6,237,297 | B1 * | 5/2001 | Paroly | 52/652.1 |
| 6,308,469 | B1 * | 10/2001 | Leung | 52/167.3 |
| 6,314,696 | B2 * | 11/2001 | Fust, III | 52/422 |
| 6,651,306 | B1 * | 11/2003 | LePoire et al. | 29/430 |
| 6,668,507 | B2 * | 12/2003 | Blanchet | 52/601 |
| 6,761,007 | B2 * | 7/2004 | Lancelot et al. | 52/426 |
| 7,356,972 | B2 * | 4/2008 | Leek et al. | 52/650.3 |
| 7,356,974 | B2 * | 4/2008 | Tadich | 52/693 |
| 7,627,997 | B2 * | 12/2009 | Messenger et al. | 52/309.17 |
| 7,634,888 | B2 * | 12/2009 | Cloyd et al. | 52/653.1 |
| 7,913,472 | B2 * | 3/2011 | Troth et al. | 52/696 |
| 8,297,017 | B2 * | 10/2012 | Platt et al. | 52/319 |
| 2001/0004815 | A1 * | 6/2001 | LePoire | 52/204.2 |
| 2001/0015045 | A1 * | 8/2001 | Paroly | 52/652.1 |
| 2002/0046524 | A1 | 4/2002 | Li et al. | |
| 2002/0046534 | A1 * | 4/2002 | Heinly et al. | 52/693 |
| 2002/0116892 | A1 * | 8/2002 | Baranian | 52/693 |
| 2003/0208987 | A1 * | 11/2003 | Lancelot et al. | 52/797.1 |
| 2006/0196140 | A1 * | 9/2006 | Crookston | 52/636 |
| 2008/0098676 | A1 * | 5/2008 | Hutchens | 52/281 |
| 2009/0272063 | A1 * | 11/2009 | Siu | 52/650.3 |
| 2010/0126103 | A1 * | 5/2010 | diGirolamo et al. | 52/655.1 |
| 2010/0275544 | A1 * | 11/2010 | Studebaker et al. | 52/582.1 |
| 2011/0185664 | A1 * | 8/2011 | Lee et al. | 52/309.16 |

FOREIGN PATENT DOCUMENTS

| | | | |
|---|---|---|---|
| DE | 7525732 | U | 12/1975 |
| FR | 2362255 | A1 | 3/1978 |
| NZ | 537801 | A | 8/2007 |
| WO | 2006077484 | A1 | 7/2006 |
| WO | 2010036129 | A1 | 4/2010 |

OTHER PUBLICATIONS

Patent Examination Report for AU 2010337145 mailed Dec. 4, 2013.

* cited by examiner

STRUCTURAL UNIT COMPRISING A TRUSS AND FIBROUS CEMENTITIOUS SLAB BUILDING ELEMENT CONNECTED TOGETHER

RELATED APPLICATIONS

The present application is national phase of PCT/US2010/060065 filed Dec. 13, 2010, and claims priority from New Zealand Application Number 582003 filed Dec. 14, 2009.

TECHNICAL FIELD

The present invention relates to improvements to building construction. Particularly, although not exclusively, the present invention relates to a structural unit for the use in building construction of floors, roofs and walls of a building.

BACKGROUND ART

Conventional building systems such as flooring systems for the ground floor of modern domestic properties have tended to be manufactured out of wood or concrete. Both materials possess excellent thermal properties, but the sound proofing of concrete is far superior to that of conventional wooden floors. As it is not practical (or often cost effective) to construct the second or subsequent floor of domestic buildings with concrete, these subsequent floors are usually manufactured from wooden floor joists, floor boards and/or particle board sheets.

The lack of sound proofing afforded by such flooring materials means that there will always be a tendency to hear noise such as footsteps of an individual walking across this flooring and squeaking from relative movement of the flooring and support joists.

In an attempt to address the problem of noise travelling between floors, soundproof insulation can be installed in the gap between the ceiling and the flooring of the next level which are separated by wooden trusses or joists.

This has been successful to some degree and the design of such trusses also enable conduits or wiring to be positioned between floors. However, the installation of additional soundproofing material increases the time and cost of building construction.

New Zealand Patent No. 537801 discloses a system and method which combine timber or steel trusses with pre-manufactured concrete floor elements to create a modular flooring system for inter level floors in buildings. Such a system was developed to alleviate the problem of noise travelling between floors by utilising concrete in a cheap and convenient manner. As concrete has inherent insulation properties it eliminates the need for additional insulation material to be installed between the ceiling and the flooring of the next level.

However, it is difficult to connect the pre-manufactured concrete floor elements to the timber trusses when employing the system and method of New Zealand Patent No. 537801. That is because the concrete elements need to be bolted directly to the timber trusses following alignment of the corresponding apertures. This alignment process can be difficult and time consuming. Also following alignment and joining, an industrial epoxy resin is often applied to the join to give the join requisite bond and strength. This process is labour intensive and also increases the time and cost of manufacture. Furthermore, the use of concrete increases the overall weight of the finished product (given that the practical minimum thickness of the concrete floor elements is 80 mm to ensure adequate cover of the reinforcing steel).

Issues with the weight of standard concrete have been resolved to some extent by the development of lightweight formulations. However, the use of lightweight concrete is also limited due to its lack of ductility. While conventional concrete is hardly known for its ductility, the cracking and brittle nature of concrete is even more pronounced in lightweight concrete, because the lightweight aggregate is typically weaker than the cement matrix, and provides little resistance to crack propagation. For products produced from such lightweight concrete, the fracture energy is typically only a fraction of that of conventional concrete.

Accordingly, it would be advantageous to provide an improved building system and method which alleviates the foregoing disadvantages of noise travelling between floors of a building, the difficulty of connecting cementitious building elements to trusses and which is lightweight and easy to utilise yet which also has sufficient crack resistance and ductility.

It is an object of the present invention to address the foregoing problems or at least to provide the public with a useful choice.

Further aspects and advantages of the present invention will become apparent from the ensuing description which is given by way of example only.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

SUMMARY OF INVENTION

The present invention in essence relates to a structural unit for the use in flooring of a building. The structural unit includes a fibrous cementitious flooring slab and at least one truss. The truss is connected to the flooring slab by at least one connection member which is cast into the flooring slab during formation of the slab which allows connection of the truss to the flooring slab. A structural unit which includes connection member(s) which are cast into a fibrous cementitious flooring slab provides an improved construction of structural units as it reduces the difficulty of subsequently connecting the formed flooring slab to the trusses.

According to one aspect of the present invention there is provided a structural unit for a building comprising:

- at least one truss;
- at least one fibrous cementitious building element; and
- at least one connection member configured to connect the at least one truss to the at least one fibrous cementitious building element, wherein, the connection member is integral with the building element and accessible for connection of the at least one truss to the building element.

Preferably, the fibrous cementitious building element is manufactured out of Engineered Cementitious Composite (ECC) material.

Preferably, the connection member is in the form of a gang-nail or nail plate(s).

More preferably, the nail plate(s) is a toothed metal shear plate(s).

Preferably, the plate(s) is fixed to a top chord sequentially along the length of the truss.

More preferably, the plate(s) is configured so that the plate(s) stands proud of the top chord of the truss.

Preferably, the plate(s) is configured so that it does not protrude through the surface of the fibrous cementitious building element when connected to the truss after pouring and setting of cementitous material.

Preferably, the connection member is integrally formed within a steel fabricated truss.

More preferably, the integrally formed connection member is extruded or formed from the steel fabricated truss.

Preferably, the fibrous cementitous building element includes at least one keying rebate recess or lineal recessed slot which is formed in the building element during the casting process.

More preferably, the recess is positioned along at least one edge of the building element where corresponding structural flooring units join.

Preferably, the fibrous cementitious building element includes at least one key hole cavity which is formed in the building element during casting of the fibrous cementitious building element.

More preferably, the key hole cavity receives a secondary connection member and grout.

More preferably still, the secondary connection member is a foot anchor or headed stud.

Preferably the fibrous cementitious building element is pre-cambered during the casting of the fibrous cementitious building element.

According to another aspect of the present invention there is provided a method of constructing a structural unit comprising the steps of:

a. providing at least one truss;
b. providing at least one connection member configured to connect the at least one truss to an at least one fibrous cementitious building element;
c. positioning the connection member for casting into the fibrous cementitious building element; and
d. curing the fibrous cementious building element thereby integrating the connection member into the fibrous cementitious building element for connection of the at least one truss to the fibrous cementitious building element.

BRIEF DESCRIPTION OF DRAWINGS

Further aspects of the present invention will become apparent from the following description which is given by way of example only and with reference to the accompanying drawings in which.

BEST MODES AND ILLUSTRATIVE EXAMPLES

The invention is now described in relation to preferred embodiments of the present invention.

Figure 1:
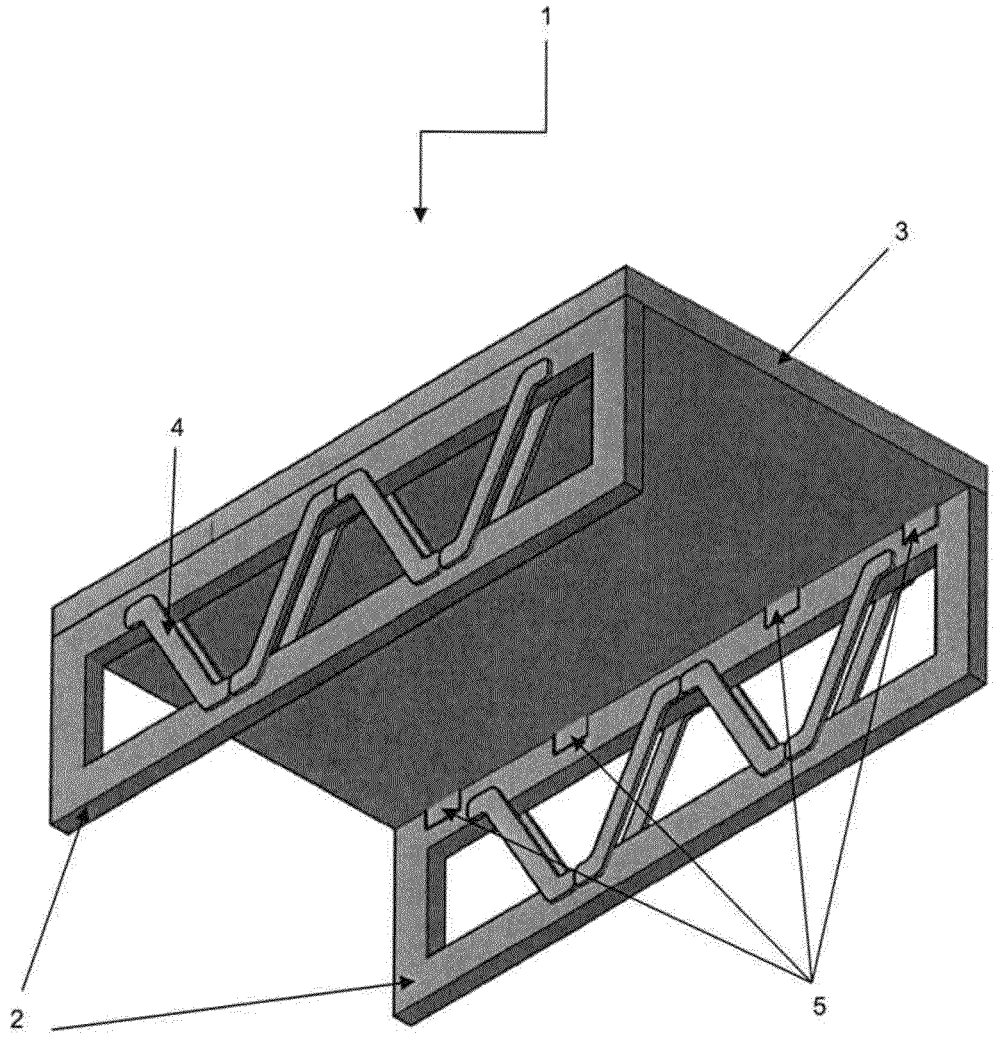
FIG. 1 shows a bottom perspective view of a preferred embodiment of the present invention, a structural unit.
Figure 2:
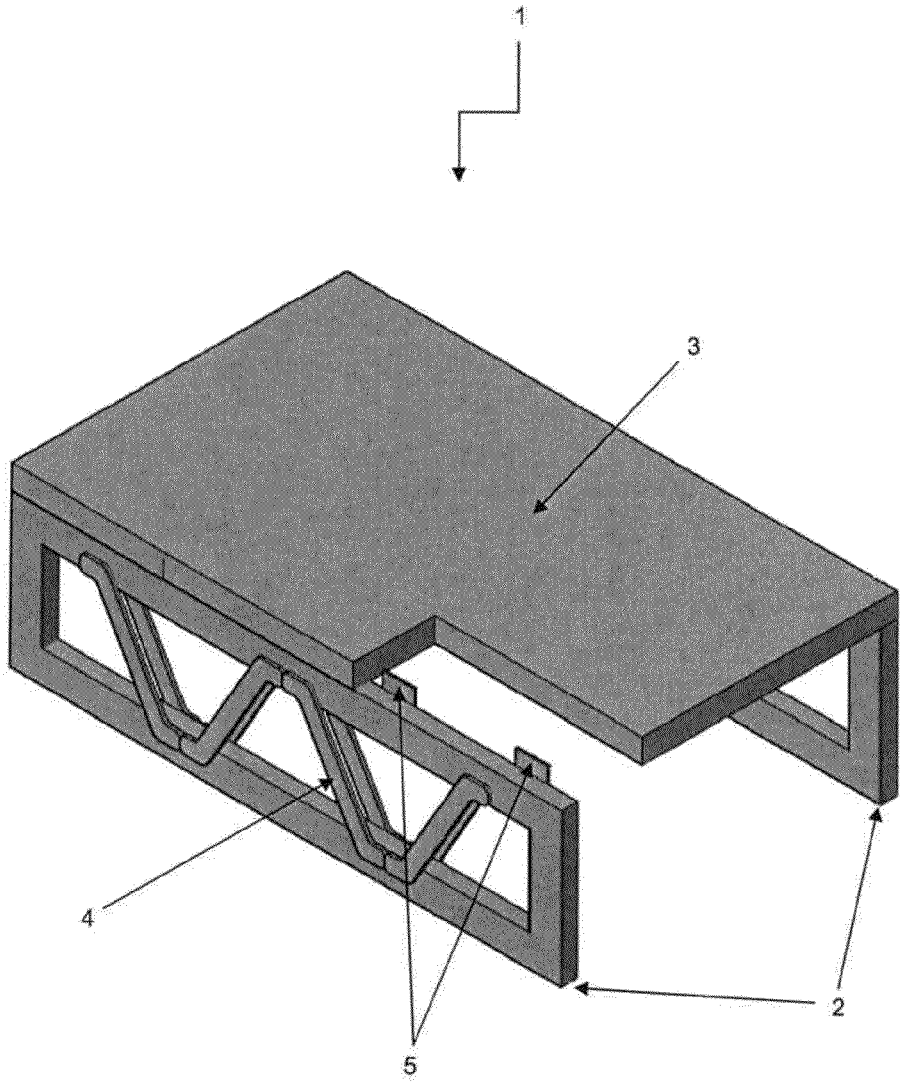
FIG. 2 shows a cut-away top perspective view of a structural unit of FIG. 1.

FIGS. 1 and 2 show an assembled structural unit generally indicated by arrow 1. FIG. 1 depicts a bottom perspective view of this embodiment and for clarity, FIG. 2 shows a cut-away top perspective view of FIG. 1. In this preferred embodiment, a flooring unit is ready for storage or transportation to a building site. It should be appreciated by those skilled in the art that this is only one example and other types of structural units such as those used in roofs and walls could conceivably be used without departing from the scope of this invention.

The exemplary structural unit (1) includes two wooden trusses (2), a fibrous cementitious building element (3), reinforcing 'V' shaped metal webs (4), and primary metallic connection members (5).

Trusses

The trusses (2) are manufactured out of wood and are typical Pryda Span™ trusses manufactured by Pryda Fabricators New Zealand. These are wooden frames fitted with reinforcing 'V' shaped metal webs (4) (Pryda Span Webs™) on opposing sides of the wooden frame.

Pryda Span™ floor trusses are well known in the industry and Table 1 shows typical spans and associated properties for use with this invention.

Primary Connection Member-Plate

Figure 3:
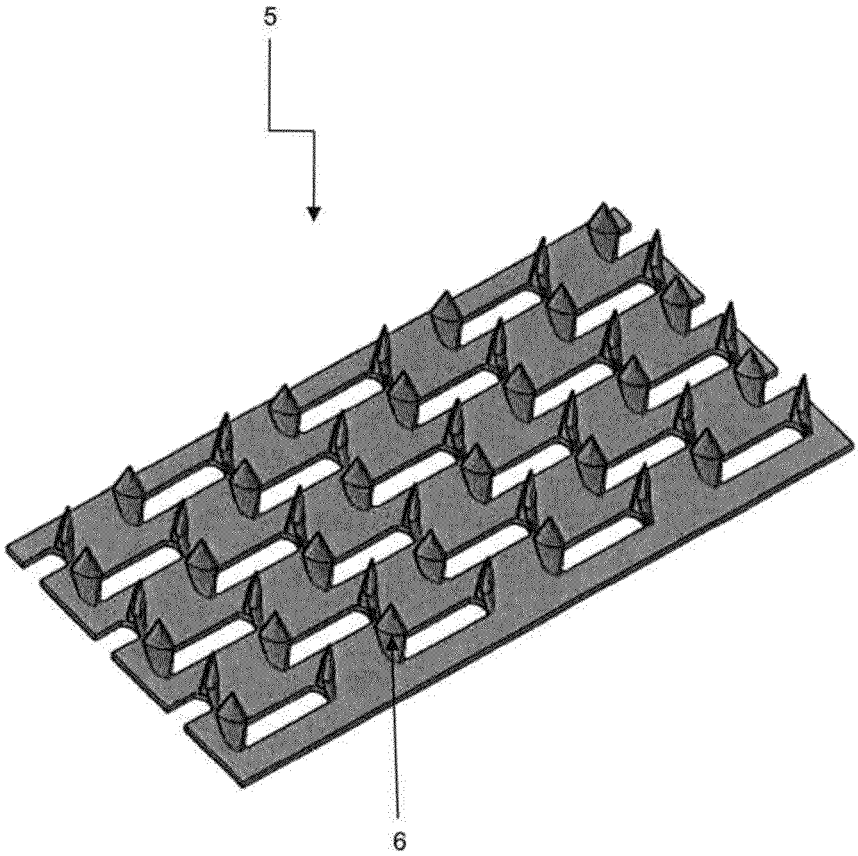
FIG. 3 shows a diagrammatic representation of a Pryda Claw™ plate.

A primary connection member in the form of a nail plate (5) is shown used to connect the trusses (2) to the fibrous cementitous building element (3). A typical nail plate (5) used for wooden trusses is a Pryda Claw™ plate. This plate (5) is a toothed metal shear plate and is best seen in FIG. 3.

The plate(s) (5) are attached sequentially along the length of the framing timber by teeth (6) and are fixed to the top chord of the timber truss (2). The plate(s) (5) are configured so that each plate (5) stands proud of either the top chord of the timber truss (2) (when directly attached to the timber truss (2) prior to casting) or stands proud within a casting bed (when directly cast into the bed prior to attaching to the timber truss (2)) by a predetermined amount as best seen in FIG. 2.

It will be appreciated by those skilled in the art that the amount the plate (5) stands proud of either the top chord or within a casting bed is dependent on the thickness of the cementitious building element (3), and the length of the plate (5) should be dimensioned and/or positioned accordingly so that it does not protrude through the surface of the cementitious building element (3) when connected to the truss (2) after pouring and setting of the cementitious material.

Cementitious Building Element

The building element (3) shown throughout the specification is a flooring slab. However, other examples may include, but are not limited to, a roof or wall slab, unit or component.

The building element (3) is manufactured out of fibrous cementitious material. Throughout this specification the term 'fibrous cementitious' should be understood to include engineered cementitious composites (ECC) and/or mixtures thereof, and other building compositions which rely on hydraulic curing mechanisms.

In particular, the building element (3) is manufactured out of ECC material. ECC has unique properties such as ductility and improved durability. The advantage of ECC material is that it provides the structural integrity of reinforced concrete, but without the weight or thickness of conventional concrete as additional steel reinforcing is not required. Typical properties and engineering design values of ECC material suitable for use with this invention are shown in Table 2. It has been shown that ECC material with these properties are particularly well suited for use in structures such as building elements where severe loading or high deformation is imposed.

Furthermore, ECC has the property of 'self-compactability' which enables the mixed material to flow under its own weight and fill each corner of the formwork in cast processing without any, or a substantial amount of, external vibration.

The building element (3) is formed within a casting bed or formwork. Casting is a well known process as will be apparent to those skilled in the art and need not be described in detail throughout the specification.

The building element (3) is dimensioned with a depth or thickness of 30 mm. This depth or thickness has been determined to produce a light weight building element with the requisite strength for application as a floor slab.

Figure 4:
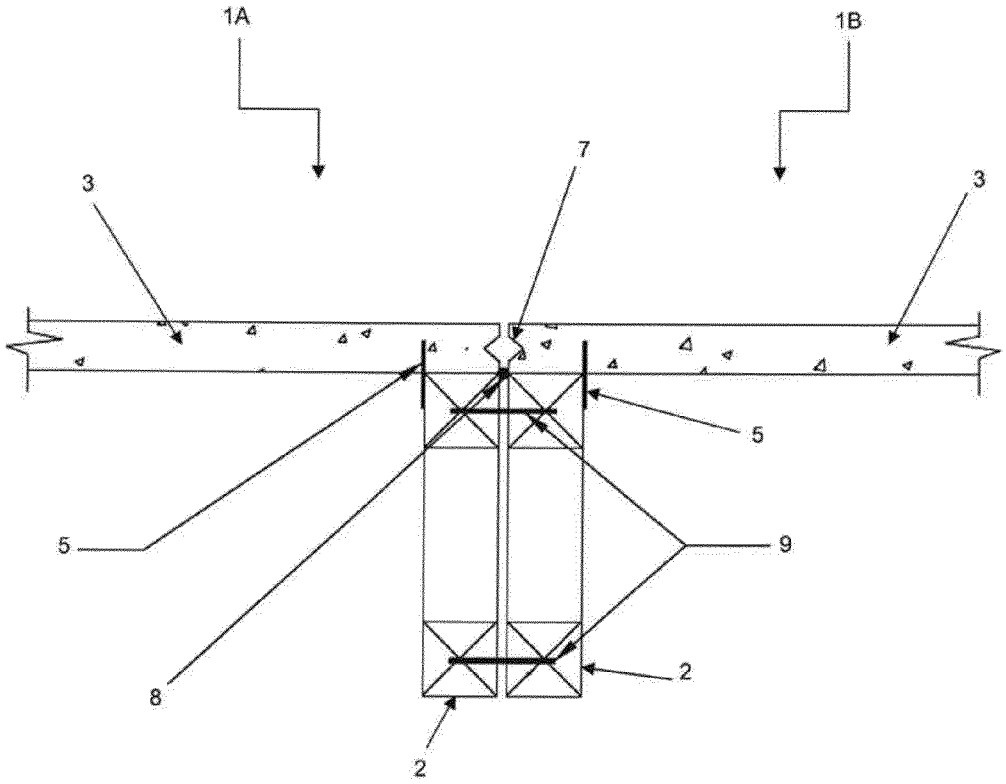
FIG. 4 shows a sectional view of an application of the structural unit of FIGS. 1 and 2, an end view of two structural floor units joined together.

In the application where two or more building elements (3) are aligned substantially adjacent to each other, at least one keying rebate recess (7) (as shown in FIG. 4) or lineal recessed slot is formed in the building element (3) during the casting process (using, for example, Reid Construction System New Zealand's solid fillet section). Formers for the rebate recess should also be placed in the formwork prior to pouring of the cementitious material (in known fashion).

FIG. 4 depicts the keying rebate recess (7) detail which is positioned along at least one edge of the building element (3) where corresponding structural flooring units (1A, B) join (as described later in this specification). The purpose of the recess (7) is to allow grout (not shown), to key between corresponding structural flooring units (1A, B). A foam backing rod (8) is inserted into the gap where the cementitious building elements (3) are aligned substantially adjacent to each other. The backing rod (8) prevents any grout which is applied to the keying rebate recess (7) from passing through the gap between the cementitious building elements (3).

Assembly and Manufacture of Structural Flooring Unit

The structural flooring unit (1) for use in building construction is pre-fabricated. Throughout the current specification the term 'pre-fabricated' should be understood to mean any process of fabrication in which the structural unit (flooring or otherwise) is substantially pre-formed prior to its use in the construction application. As will be apparent to those skilled in the art this may occur on or off site. However, it is envisaged that no on-site fabrication will be necessary as an off site pre-fabricated structural unit (1) will permit installation of the structural unit (1) immediately after lifting into place by crane and/or construction personnel.

In use a structural floor unit (1) as depicted in FIGS. 1 and 2 is assembled and manufactured as follows:

1. One or more Pryda Span™ wooden trusses (2) are selected according to the required span length (see Table 1) and characteristics determined by those skilled in the art. A flooring unit utilising two trusses has been depicted in FIGS. 1 and 2 for exemplary purposes.
2. In addition to reinforcing metal webs (4), toothed metal shear plates (5) are fixed by teeth (6) to one side of the top chord of the timber trusses (2) so that a portion of the toothed plate (5) stands proud of the top chord by a predetermined amount (determined so as not to penetrate through the top surface of the cementitious building element (3) when cast as previously described).
3. The cementitious building element (3) is cast using a separate formwork/casting bed (not shown) (which will be well known to those skilled in the art). The formwork/casting bed is dimensioned and set-up according to the size/features of building element (3) required.

In preferred embodiments, the cementitious building element (3) of the flooring unit will be 30 mm thick× length 3000 mm×width 1200 mm. This has been found by the applicant to be suitable for application as a floor slab. The plates (5) should extend no more than 30 mm from the top chord of the trusses (2). This has been found by the applicant to be suitable for connection purposes.

A person skilled in the art will appreciate that the overall dimensions, thickness and features can be varied without departing from the scope of the invention.

Following set-up, engineering cementitious composite material is then poured into the formwork/casting bed in known fashion.
4. While the ECC material is curing, each of the Pryda Span™ wooden trusses (2) are positioned by inverting so that the metal plates (5) are facing downward and may be sunk into the cementitious material. The top edge of trusses (2) will lie on top of the cementitious material so as to prevent over-insertion. Trusses (5) are positioned adjacent and substantially parallel to each other and the metal plates (5) connected to the trusses (2) are allowed to set in the layer of ECC material.

5. The ECC material in then cured in known fashion and bonds to the metal plates thereby permanently attaching the Pryda Span™ wooden trusses (2) to the cementitious building element (3).
6. After curing of the ECC material, the structural floor unit (1) is lifted from the formwork/casting bed in known fashion and re-inverted (ie with the cementitious building element facing upwards) for storage or transportation to a building site.

Application Example

A Modular Flooring System with Wooden Trusses

An exemplary application of the present invention is now described with reference to FIG. 4.

This Figure shows an end view of the use of two structural units (1A, B) in the manufacture of a lightweight pre-finished flooring system. At a required building site (not shown), each pre-fabricated structural flooring unit (1A, B) comprising cementitious building element (3), wooden truss (2) and toothed metal plates (5) is lifted and aligned substantially adjacent to each other, for example by crane and/or skilled construction personnel.

It should be appreciated that the structural flooring units (1A, B) are secured perpendicular to truss support members (not shown) by any method suitable to those skilled in the art. However, the structural flooring units (1A, B) are typically delivered to a site and set and secured on corresponding truss support members (such as wall frames) which form part of a building as is described in New Zealand Patent Application No. 537801.

Following alignment, the structural flooring units (1A, B) are structurally connected to each other by 90 mm timber skew nails (9) being driven into the adjacent trusses (2). For a 1.5 kPa live load, it has been determined that 5 timber skew nails (9) are required per lineal meter.

Depending on the size of the floor desired, structural units in addition to (1A, B) may be lifted into position so that multiple cementitious building elements (3) are aligned substantially adjacent to each other.

FIG. 4 also depicts the keying rebate recess (7) detail. In use, a foam backing rod (8) is inserted into the gap where the cementitious building elements (3) are aligned substantially adjacent to each other. The backing rod (8) prevents any grout (not shown) which is applied to the keying rebate recess (7) from passing through the gap between the cementitious building elements (3) to provide a ductile join.

DESCRIPTION OF ALTERNATIVE WAYS TO IMPLEMENT THE INVENTION

The invention is now described in relation to alternative embodiments of the present invention.

Alternative Structural Units and Trusses

Figure 5:
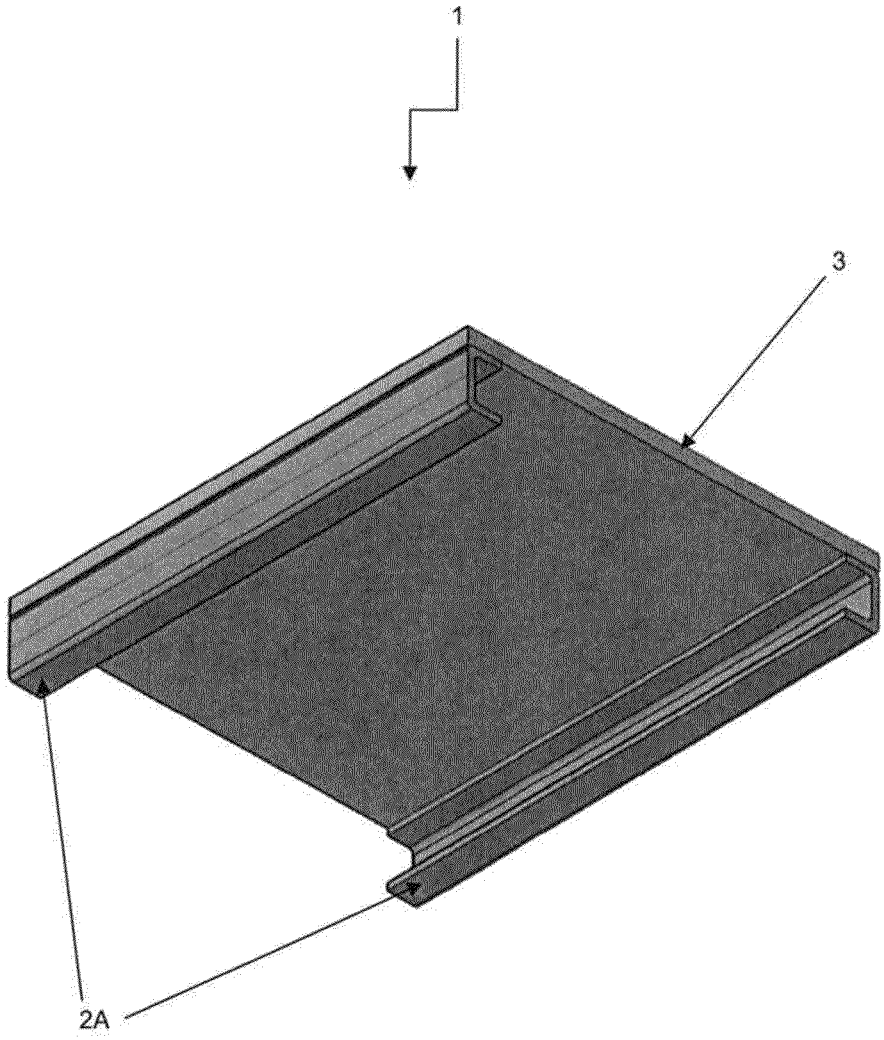
FIG. 5 shows a bottom perspective view of an alternative embodiment of the present invention, an assembled structural floor unit with metal C-sections.
Figure 6:
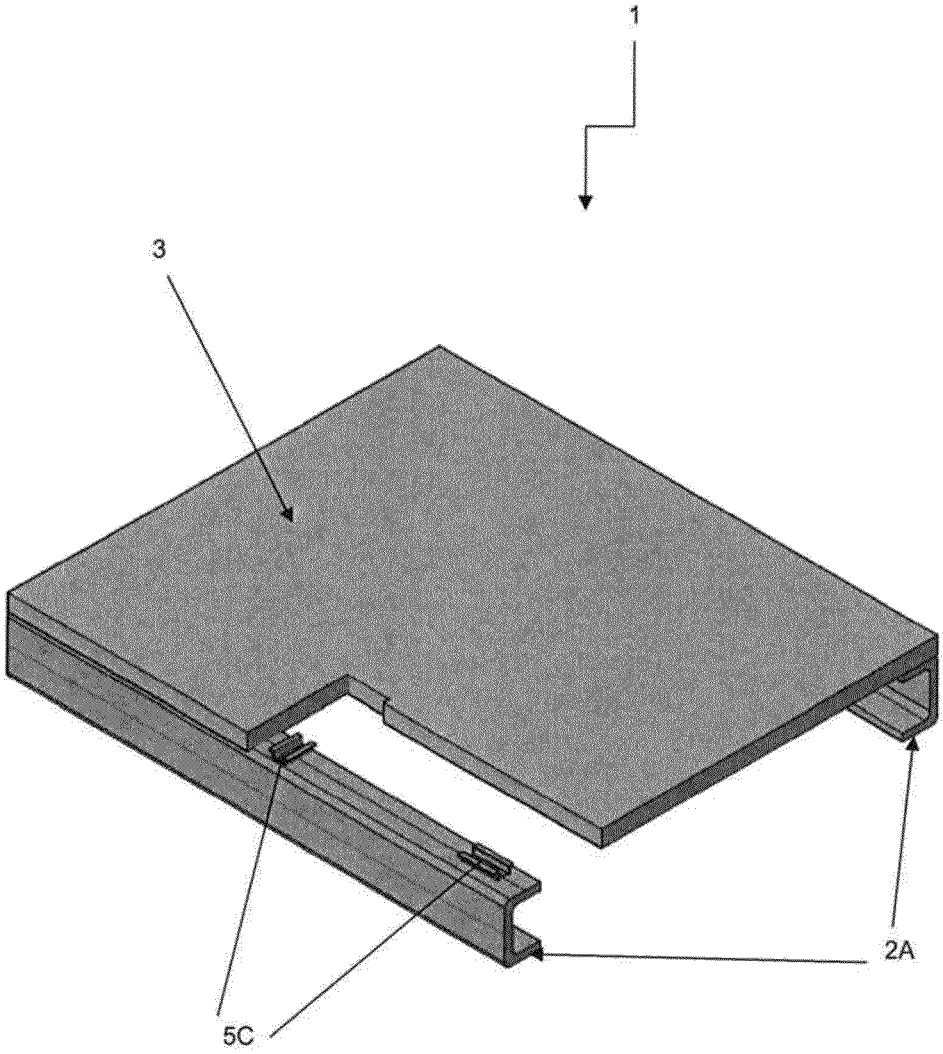
FIG. 6 shows a cut-away top perspective view of an assembled structural unit of FIG. 5.

FIGS. 5 and 6 show an assembled structural unit (1), in this alternative embodiment the flooring unit includes two metal fabricated trusses (2A) in the form of C-sections (manufactured by Rolled Forming Services New Zealand), a cementitious building element (3), and primary metallic connection members (5C).

Figure 7:
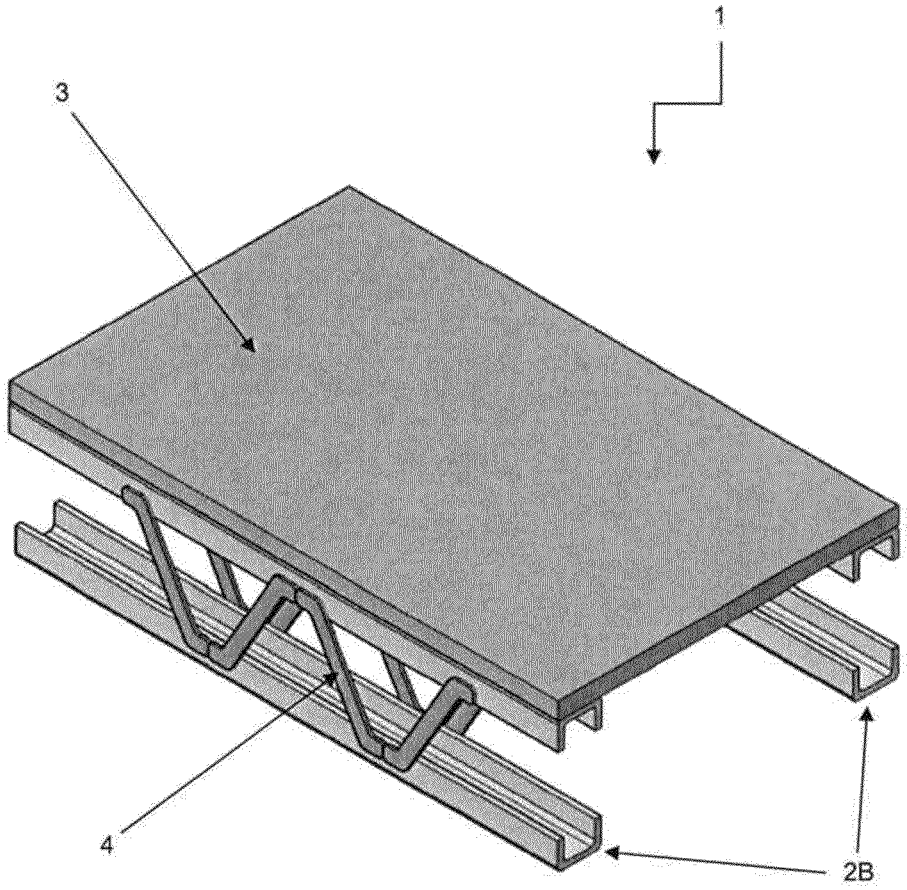
FIG. 7 shows a top perspective view of an alternative embodiment of the present invention, an assembled structural unit with pre-fabricated metal trusses.
Figure 8:
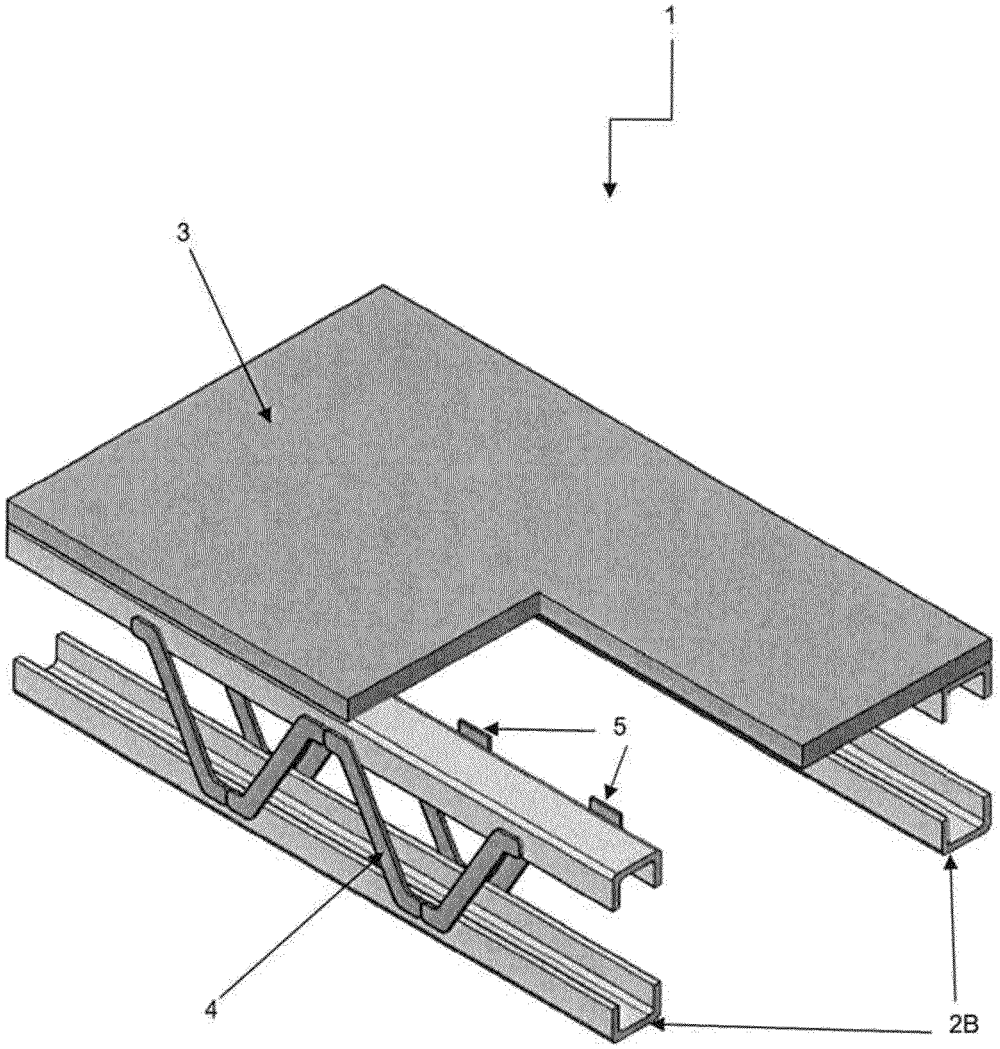
FIG. 8 shows a cut-away top perspective view of an assembled structural unit of FIG. 7.

FIGS. 7 and 8 show an assembled structural unit (1), in this further alternative embodiment the flooring unit includes two metal pre-fabricated Axis™ trusses (2B) (manufactured by Axis Steel Framing New Zealand) in the form of C-sections with top and bottom chords connected by reinforcing 'V' shaped metal webs (4), a cementitious building element (3), and primary metallic connection members (5) as shown in FIG. 8.

Some advantages of utilising steel over wooden truss systems is that they offer additional fire resistance and can withstand greater windage experienced in adverse climates.

Other alternative truss systems may include but are not limited to MiTek™ truss systems manufactured by MiTek™ New Zealand Ltd, Laminated Veneer Lumbar (LVL) joists, I beams or rolled metal Z sections.

The structural flooring units depicted in FIGS. 5, 6, 7 and 8 which include metal truss systems are assembled and manufactured as previously described for structural units with wooden trusses. However, there are variations to the types of connection members utilised and their attachment when configured for use with steel truss systems as discussed below.

Alternative Connection Members for Use with Steel Truss Systems

Figure 9:
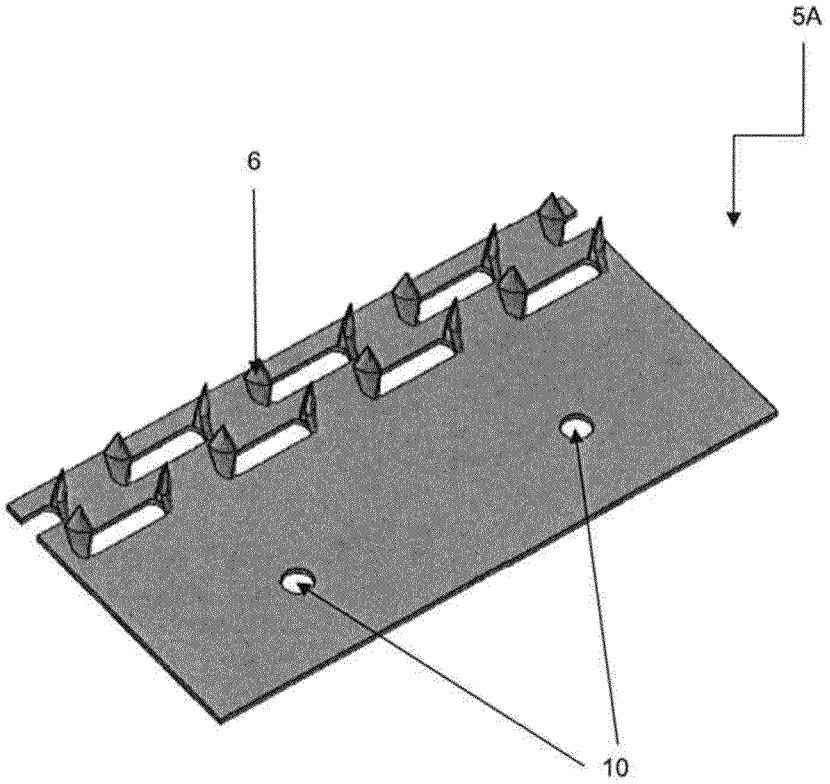
FIG. 9 shows an alternative connection member in the form of a metal shear plate configured for use with steel truss systems.

FIG. 9 shows an alternative connection member in the form of a metal shear plate (5A) for use with steel truss systems. The plate (5A) includes teeth (6) for purchase of the fibrous cementitous material and holes (10) for fixing to the steel truss system.

Figure 10:
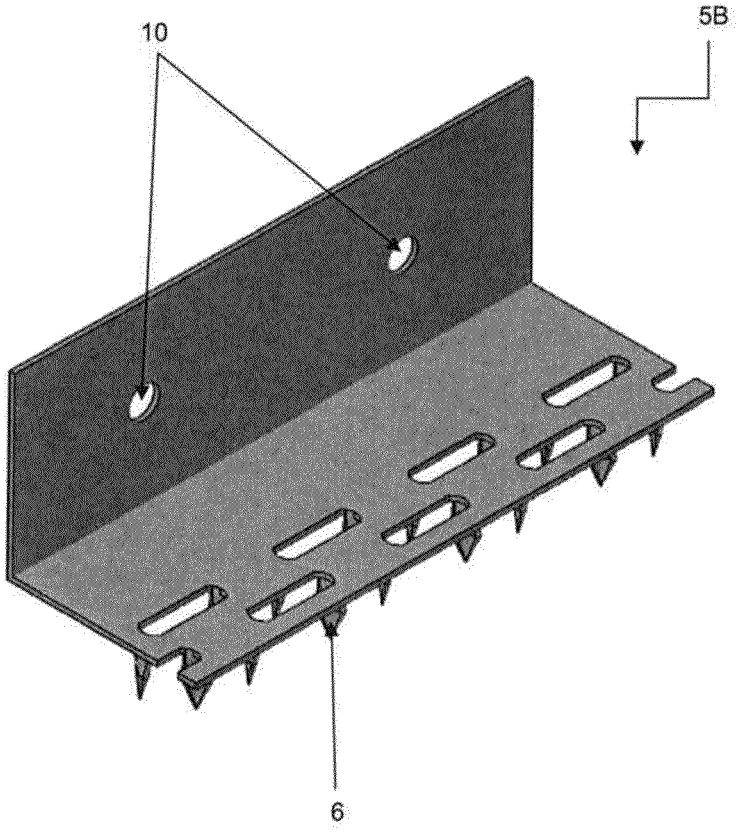
FIG. 10 shows an alternative connection member in the form of an L-shaped sheer plate configured for use with steel truss systems.

FIG. 10 shows a further alternative connection member in the form of a L-shaped shear plate (5B) or cleat configured for use with steel truss systems. The plate (5B) includes teeth (6) for purchase of the fibrous cementitous material and holes (10) for fixing to the steel truss system.

Figure 11:
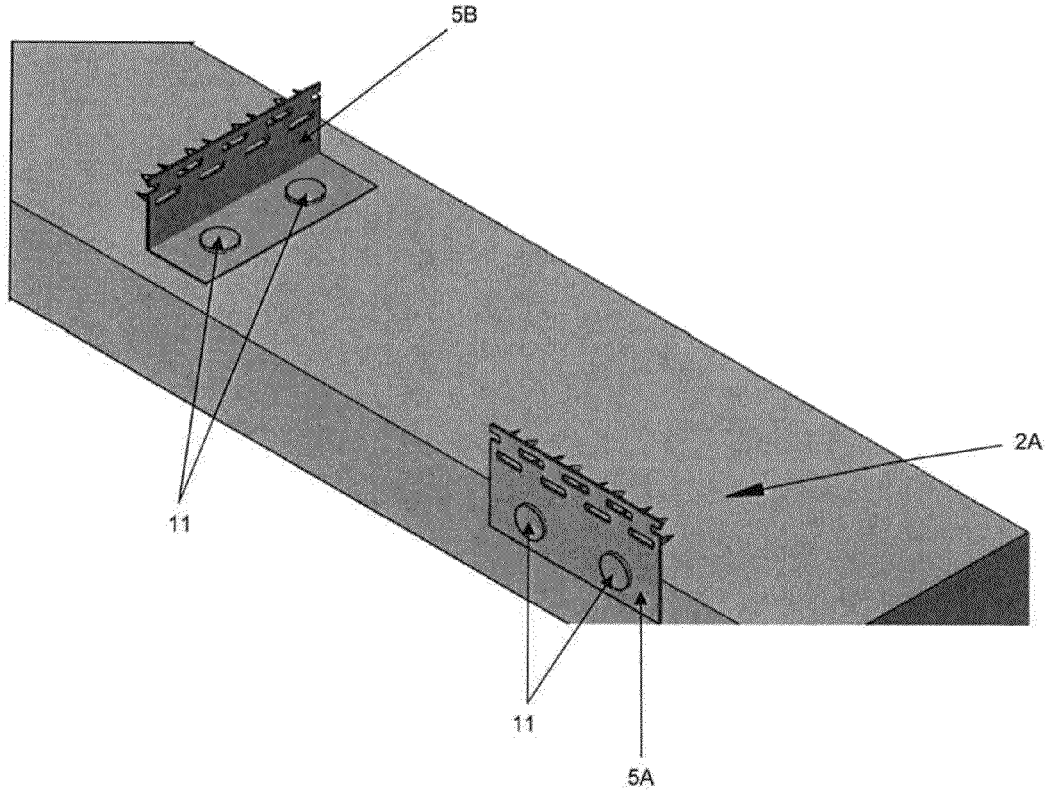
FIG. 11 shows the positioning and fixing of the alternative connection members of FIGS. 9 and 10 on a steel truss system.

FIG. 11 shows the positioning of plates (5A and 5B) depicted in FIGS. 9 and 10. The plate (5A) is positioned on one side of the steel truss so that a portion of the toothed plate (5A) stands proud of the top chord by a predetermined amount (determined so as not to penetrate through the top surface of the cementitious building element when cast as previously described). Once positioned, the plate (5A) is fixed to one side of the steel truss by inserting self tapping Tek screws (11) into the holes (not shown) and directly drilling into the steel truss (2A). The plate (5B) is positioned and fixed on the top face of the steel truss (2A) to provide additional transfer of shear force. The plate (5B) is fixed to the steel truss (2A) and stands proud of the top face of the chord as previously described.

Figure 12:
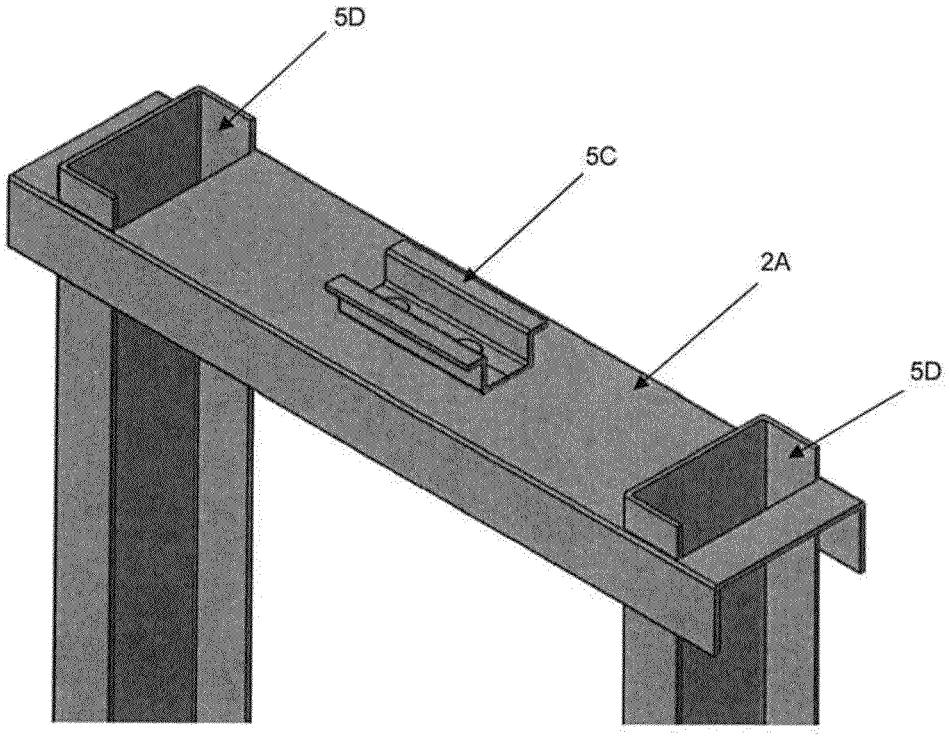
FIG. 12 shows a further two alternative connection members in the form of a Rhondo plate and C-section truss support members.

FIG. 12 shows a further two alternative connection members in the form of a Rondo plate (5C) and C-section truss support members (5D) which protrude through the face of the steel truss (2A). As previously described for plate (5B), the Rondo plate (5C) is positioned and fixed on the top face of the steel truss (2A) by Tek screws to provide additional transfer of shear force. The protruding C-section truss support members (5D) also act as connection members when the cementitious building element is cast.

In addition to the above connection members configured for use with steel trusses, it should be appreciated by those skilled in the art that the steel connection members may be formed integrally with the steel truss. For example, if a metal section is used, the connection member could be formed by punching out a tab or plate.

Furthermore, other methods of fixing metal plates may include, but is not limited to welding directly onto the steel truss.

Alternative Connection Member for Use with Wooden Truss Systems

Figure 13:
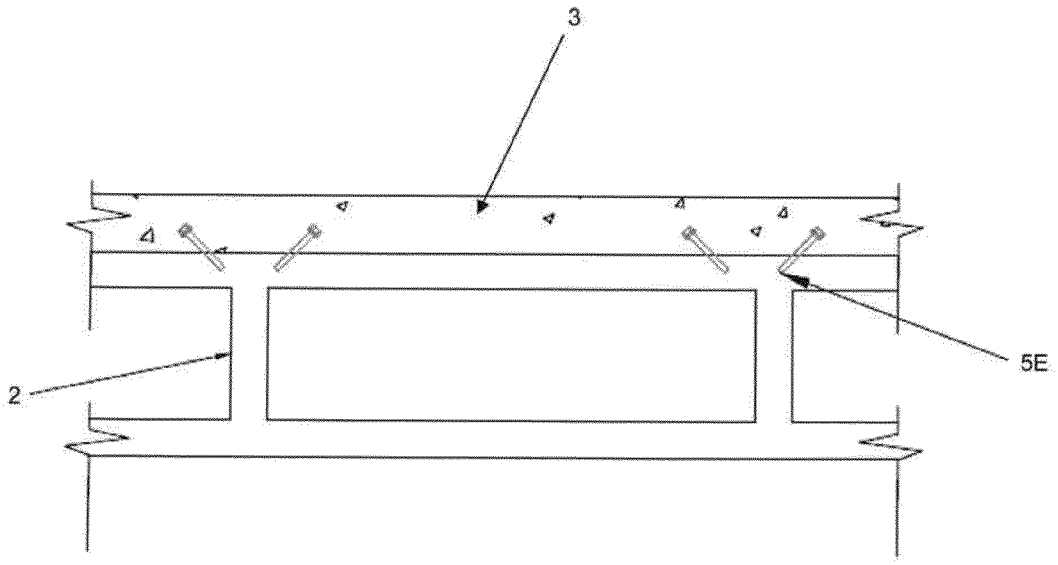
FIG. 13 shows a sectional view of an assembled structural unit comprising alternative connection members in the form of bolts, screws or nails for use with wooden truss systems.

FIG. 13 shows the application of an alternative connection member in the form of bolts, screws or nails (5E) angled at 45° into the wooden truss (2). In this embodiment, the angled bolts, screws or nails (5E) are fixed to the wooden truss (2) and the truss is inverted and placed onto the cementitious building element (3) prior to curing as previously described. The applicant has found that the use of this type of connection member also provides the transfer of shear force.

Alternative Cementitious Building Element and Diaphragm Join

Figure 14:
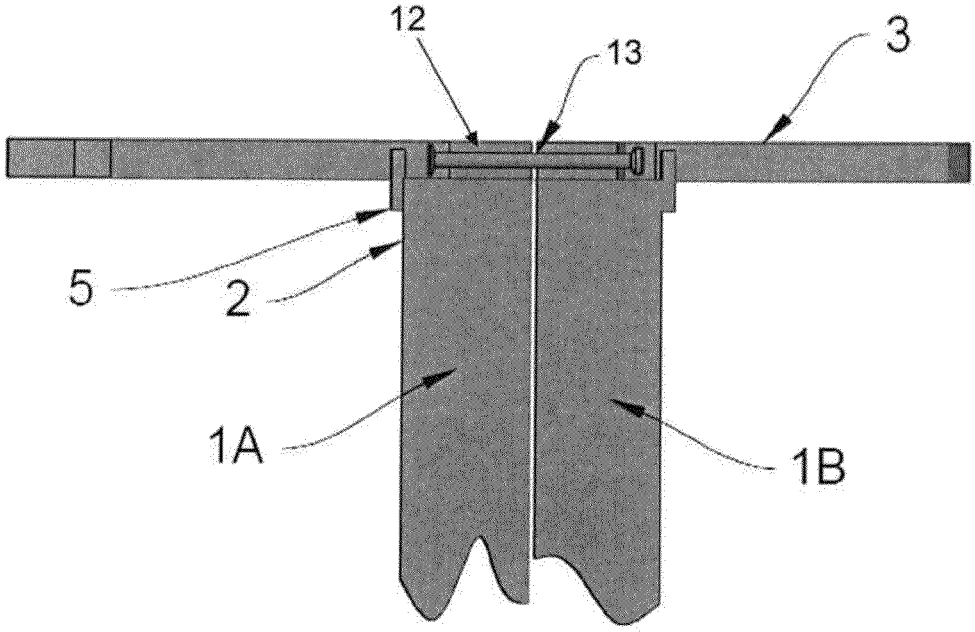
FIG. 14 shows a diagrammatic representation of the two structural units of FIG. 4 with secondary connection member detail of a foot anchor.
Figure 15:
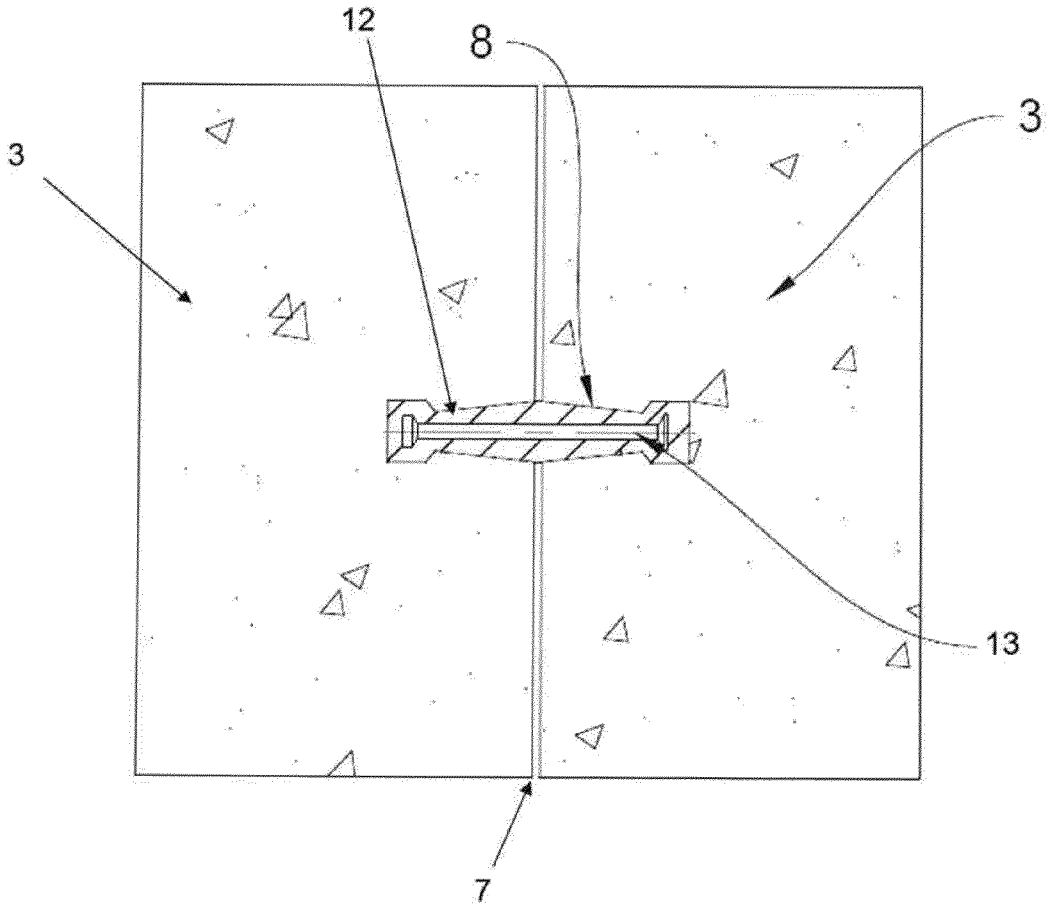
FIG. 15 shows a plan view of the two structural units with a foot anchor as shown in FIG. 14.

In an alternative embodiment, in addition to the keying rebate recess (7), at least one key hole cavity (12) (as shown in FIGS. 14 and 15) is formed in the building element (3) during the casting process—formers for the key hole cavit (ies) should be placed in the formwork prior to pouring of the cementitious material (in known fashion).

The purpose of the keyhole cavity (12) is to receive a secondary connection member and grout.

Such a secondary connection member will be well known to either those skilled in the art. For example, a common secondary connection member, known as a 'foot anchor' or 'headed stud' (13), comprises a circular shaft with a head at one end of the shaft and a foot at the other end of the shaft, the head and foot being of a greater diameter than the diameter of a shaft (i.e. similar in appearance to a 'dumb bell'). For ease of reference throughout the specification, the secondary connection member may now simply be referred to as a foot anchor (13). The use of which is described below and depicted in FIGS. 14 and 15.

Foot anchors (13) are placed in the key hole cavity (12) created during the casting process (as previously described). Finally, grout (depicted in shaded lines in FIG. 15) is applied to the keying rebate recess (7) and key hole cavities (12) between the flooring building elements (3). The layer of grout covers the recess (7), key hole cavity (12) and foot anchor (13) and, together with the foot anchors, provides a ductile joint and rigid diaphragm of the whole floor between the connected pre-fabricated floor structural units (1A and B). This creates a continuous floor to floor fully reinforced and connected membrane. A structural connection prepared as described above allows for development of shear friction where higher live loads are anticipated. This is a significant advantage as it means that the assembled floor can perform as a shear diaphragm and create a structural load path distributed between the floor sections. For example, the structural connection between the floor sections will give adequate forgiveness during a building's natural movement in wind or in the event of an earthquake.

It should also be appreciated by those skilled in the art that alternative cementitous building elements may be manufactured out of ECC material which include an anti-shrink composition to prevent shrinkage of the building element during the curing process.

Alternative Application

A modular Flooring System with C-Section Metal Trusses

An exemplary application of the present invention is now described with reference to FIG. 16.

This figure shows an end view of the use of two structural units (1A, B) in the manufacture of a lightweight pre-finished flooring system as previously described for a modular flooring system with wooden trusses.

Following alignment, the structural flooring units (1A, B) are structurally connected to each other by hex head bolts (14) being screwed into the adjacent trusses (2A). For a 1.5 kPa live load, it has been determined that [X number of bolts—please advise] are required per lineal meter.

Depending on the size of the floor desired, structural units in addition to (1A, B) may be lifted into position so that multiple cementitious building elements (3) are aligned substantially adjacent to each other.

Figure 16:
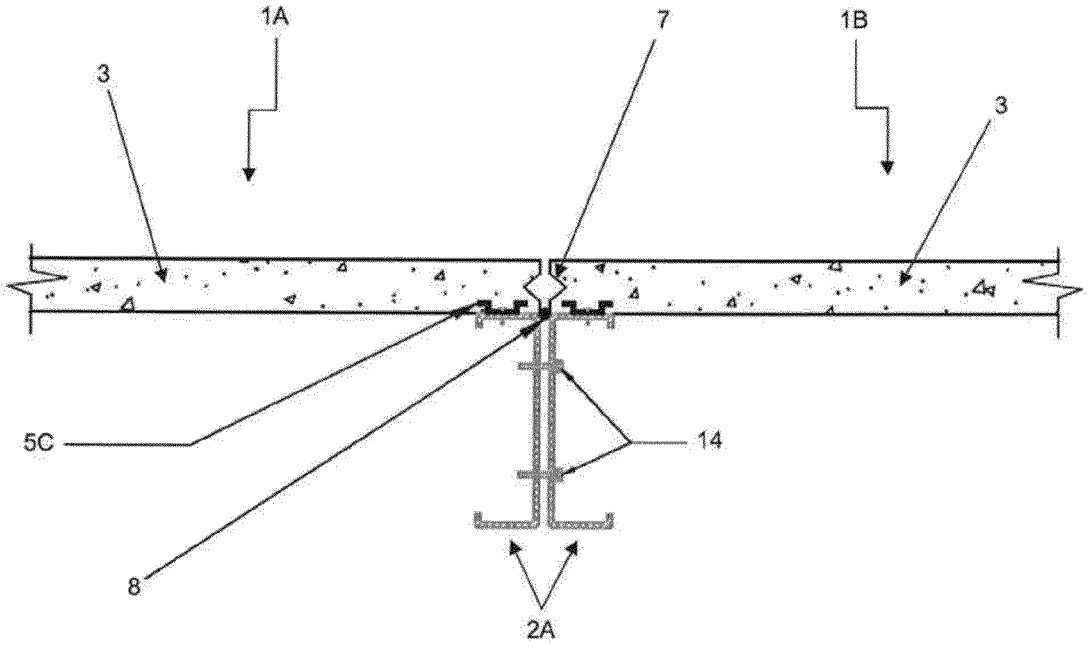
FIG. 16 shows a sectional view of an application of the structural unit of FIGS. 5 and 6, an end view of two structural units joined together.

FIG. 16 also depicts the keying rebate recess (7) detail. In use, a foam backing rod (8) is inserted into the gap where the cementitious building elements (3) are aligned substantially adjacent to each other. The backing rod (8) prevents any grout (not shown) which is applied to the keying rebate recess (7) from passing through the gap between the cementitious building elements (3) to provide a ductile join.

Alternative Assembly and Manufacture Methods

It should be appreciated by those skilled in the art that alternative assembly and manufacture methods could conceivably be used with this invention.

For example, the order of manufacture and assembly of the structural units may vary. It should not be seen as limiting that the connection members are attached directly to the trusses prior to casting of the cementitious material. In alternative embodiments, the connection members maybe positioned in the casting bed prior to casting of the cementious material, or positioned in the casting bed after casting then attached to the preferred truss system.

Other alternative manufacture methods may include pre-cambering of the cementious floors. With this manufacturing method the prefabricated floors may be delivered to a site with a slight arch or 'pre-camber' in the centre of the floor. An advantage of a pre-cambered floor is that under heavy loads, the floor remains level.

To manufacture a pre-cambered floor, keeper beams manufactured from suitable material such as timber or steel (that are the same width as the final support joists/trusses and consistently level with the contact surface of the building element) are positioned in the casting bed. The keeper beams are positioned at the same location as the final support joists/trusses.

Also, shear connection members are temporarily fixed to the keeper beams at the same location and depth as per the finished structural unit in known fashion.

The cementitious building element is then cast as previously described. Once the building element can be removed from the casting bed, it is lifted into a storage area and allowed to fully cure so that any shrinkage of the building element is achieved.

The keeper beams are removed by detaching the shear connection members and replaced by the finished support beams/trusses which are placed in the previous keeper beam locations. The shear plates are re-attached to the finished support beams/trusses sufficiently to allow the floor module to be inverted so that the beams are located under the building element as for installation purposes. With the structural unit supported near the ends of the span and at a convenient height off the ground, the building element is released from the shear connection members sufficiently to allow the building element to take up the pre-camber curve of the beams/truss so that the building element contacts the top face of the joist/truss completely along its length. The connection member shear plates are then finally secured and fixed to beams/trusses in known fashion to transfer shear loads in the structural unit.

ADVANTAGES OF THE INVENTION

There are many advantages associated with this invention:

The method of building construction provides an improved solution for connecting cementitious building elements to various truss systems.

The use of ECC material provides a structural unit with the structural integrity of reinforced concrete, but without the weight or thickness associated with concrete. The weight of the finished structural unit is similar to a conventional wooden floor with no special engineering or structural requirements necessary. As the floor becomes a single diaphragm when the grout has set, it gives superior bracing properties to a conventional glued and screwed floor.

Very large spans can be built in combination with Reid Construction System New Zealand's Post Tension technology. The finished dimension of a building element is only limited by the dimension of the casting bed and equipment available to transport and install the structural unit.

The pre-fabricated structural unit can be manufactured off-site. Therefore, no on-site pouring is required which reduces installation costs. The structural unit creates an instantaneous safe working platform allowing the contractor to install further units for the next building level immediately after lifting and securing the building (floor) elements into place.

The lightweight pre-fabricated structural unit can be easily lifted and installed in considerably shorter time frames to those associated with the construction of a conventional particle board floor.

The flooring structural unit manufactured in accordance with the invention includes a convenient space with no battens or suspension systems required allowing for installation of ducting such as conduits, piping or wiring etc and the lower chord provides convenient fixing of a ceiling without the need for ceiling hangers.

As the building element is manufactured from a cementitious material, the building (e.g. floor) element is immediately protected from the weather during uncovered installation compared with a particle board floor which can deteriorate in the weather. Also, there is minimal moisture absorption and hence no maintenance required. Therefore, the product is ideal for wet areas. As there is minimal moisture absorption, this also leads to a healthier, dryer building with reduced mould or rot.

The building element manufactured out of ECC material provides a strong, crack resistant, smooth surface for the installation of tiles, carpet or similar finishes. Also, there are significant reductions in vibration and sound transfer including superior fire resistance compared with conventional particle board floors.

Aspects of the present invention have been described by way of example only and it should be appreciated that modifications and additions may be made thereto without departing from the scope of the appended claims.

TABLE 1

| Section Details Using Pryda Spa Floor Trusses | |
|---|---|
| Live load | 1.5 kPa residential<br>3.0 kPa commercial |
| Overall depth | 290 mm, 340 mm or 452 mm |
| Span | See Span Table |
| Components | |
| Pryda Span or Longreach Flexus Floor | Timber Truss floor designed by Pryda<br>Precast 30 mm in depth |
| Materials | |
| Timber | MSG12 |
| Pryda Web | PW25, PW30, PW40 |
| Flexus Floor | |

EXEMPLARY PRYDA FLOOR SYSTEM SPAN TABLES
30 mm Flexus Floor and MSG12 timber

| Pryda Span | O/A Thickness (mm) | Maximum Span (m) |
|---|---|---|
| Residential Application (1.5 kPa/1.8 kN) | | |
| PS260 @ 600 crs | 290 | 4.80 |
| PS310 @ 600 crs | 340 | 5.30 |
| PS410 @ 600 crs | 452 | 6.20 |
| PS260 @ 400 crs | 290 | 5.30 |
| PS310 @ 400 crs | 340 | 5.80 |
| PS410 @ 400 crs | 452 | 6.80 |
| Commercial Application (3.0 kPa/2.7 kN) | | |
| PS260 @ 400 crs | 290 | 5.00 |
| PS310 @ 400 crs | 340 | 5.60 |
| PS410 @ 400 crs | 452 | 6.60 |

TABLE 2

ENGINEERING DESIGN VALUES AND PROPERTIES OF ECC MATERIAL

| | |
|---|---|
| Flexural Strength | >5 MPa |
| Flexural Strength Gain after First Crack | >10% |
| Compressive Strength | >40 MPa at 28 days |
| Crack Width at Ultimate Flexural Strength | <0.21 mm |
| E Value | >15 GPa |

What we claim is:

1. A structural unit for a building comprising:

at least one truss;

at least one fibrous cementitious building element; and at least one connection member configured to connect the at least one truss to the at least one fibrous cementitious building element, wherein, the connection member is integral with the building element and accessible for connection of the at least one truss to the building element, the connection member is in the form of a plate(s), the plate(s) is fixed to a top chord of the truss, the plate(s) is configured so that the plate(s) stands proud of the top chord of the truss, and the plate(s) is configured so that it does not protrude through the surface of the fibrous cementitious building element when connected to the truss after pouring and setting of cementitious material.

2. A structural unit as claimed in claim 1, wherein the fibrous cementitious building element is manufactured out of Engineered Cementitious Composite (ECC) material.

3. A structural unit as claimed in claim 1, wherein the nail plate(s) is a toothed metal shear plate(s).

4. A structural unit as claimed in claim 1, wherein the connection member is integrally formed within a steel fabricated truss.

5. A structural unit as claimed in claim 4, wherein the integrally formed connection member is extruded or formed from the steel fabricated truss.

6. A structural unit as claimed in claim 1, wherein the fibrous cementitous building element includes at least one keying rebate recess or lineal recessed slot which is formed in the building element during the casting process.

7. A structural unit as claimed in claim 6, wherein the recess is positioned along at least one edge of the building element where corresponding structural flooring units join.

8. A structural unit as claimed in claim 6, wherein a total volume taken up by the building element is spatially separate from a total volume taken up by the at least one truss.

9. A structural unit as claimed in claim 1, wherein the fibrous cementitious building element includes at least one key hole cavity which is formed in the building element during casting of the cementitious building element.

10. A structural unit as claimed in claim 9, wherein the key hole cavity receives a secondary connection member and grout.

11. A structural unit as claimed in claim 10, wherein the secondary connection member is a foot anchor or headed stud.

12. A structural unit as claimed in claim 1, wherein the cementitious building element is pre-cambered during the casting of the cementitious building element.

13. A structural unit as claimed in claim 1, wherein the portions of the connection member integral with the building element are in the form of a planar structure extending into the building element.

14. A structural unit as claimed in claim 1, wherein the portions of the connection member integral with the building element have boundaries that extend in one or more directions of extensions all respectively generally lying in the same plane.

15. A structural unit as claimed in claim 1, wherein the portions of the connection member integral with the building element are in the form of a rectangular structure extending into the building element.

16. A structural unit as claimed in claim 1, wherein the portions of the connection member integral with the building element extend into the building element in a linear manner without a component orthogonal thereto.

17. A structural unit as claimed in claim 1, wherein the portions of the connection member integral with the building element extend into the building element in a linear manner without a component orthogonal or oblique thereto.

18. A structural unit as claimed in claim 1, wherein the truss is not integral with the building element.

19. A structural unit as claimed in claim 1, wherein the truss is a timber truss.

20. A structural unit as claimed in claim 1, wherein the truss is a metal truss.

21. A structural unit as claimed in claim 1, wherein the truss includes a plurality of elongate components including respective outer cross-sections lying on respective planes normal to respective longitudinal axes of the respective elongate components respectively having heights that are greater than thickness of the building element.

22. A structural unit as claimed in claim 1, wherein the connection member is in the form of nail plate(s) having a plurality of teeth.

* * * * *